US011521767B2

(12) United States Patent
Hsiao et al.

(10) Patent No.: US 11,521,767 B2
(45) Date of Patent: Dec. 6, 2022

(54) IGNITION RESISTOR AND METHOD FOR MANUFACTURING THE SAME

(71) Applicant: YAGEO CORPORATION, Kaohsiung (TW)

(72) Inventors: Shen-Li Hsiao, Kaohsiung (TW); Fu-Sheng Huang, Kaohsiung (TW)

(73) Assignee: YAGEO CORPORATION, Kaohsiung (TW)

( * ) Notice: Subject to any disclaimer, the term of this patent is extended or adjusted under 35 U.S.C. 154(b) by 73 days.

(21) Appl. No.: 17/306,941

(22) Filed: May 4, 2021

(65) Prior Publication Data

US 2022/0223326 A1 Jul. 14, 2022

(30) Foreign Application Priority Data

Jan. 11, 2021 (CN) ..... 202110031995.8

(51) Int. Cl.

*H01C 17/02* (2006.01)
*H01C 1/14* (2006.01)
*H01C 17/28* (2006.01)

(52) U.S. Cl.

CPC ..... *H01C 17/02* (2013.01); *H01C 1/14* (2013.01); *H01C 17/28* (2013.01)

(58) Field of Classification Search

CPC ..... H01C 17/02; H01C 17/028; H01C 1/14; H02H 9/06; H01T 2/02

See application file for complete search history.

(56) References Cited

U.S. PATENT DOCUMENTS 8,421,582 B2 * 4/2013 Hiehata ..... H01L 23/60 338/21
9,190,811 B2 * 11/2015 Soelter ..... H01T 1/24
2008/0218082 A1 * 9/2008 Boy ..... H01T 4/12 313/631
2016/0329125 A1 * 11/2016 Hong ..... H01B 5/02

FOREIGN PATENT DOCUMENTS

CN 102927590 A 2/2013
CN 203277962 U 11/2013
CN 106415955 A 2/2017
CN 109149371 A 1/2019

* cited by examiner

*Primary Examiner* — Kyung S Lee
(74) *Attorney, Agent, or Firm* — CKC & Partners Co., LLC

(57) ABSTRACT

An ignition resistor includes an ignition structure, an insulation substrate, a carrying base, and first and second conductor layers. The ignition structure includes an ignition portion, and first and second electrode portions respectively connected to two opposite ends of the ignition portion. The insulation substrate is disposed on the ignition structure and includes a filling portion including a hole exposing the ignition portion and configured to accommodate an ignition material, and a sidewall surrounding the hole. The carrying base is disposed under the ignition structure. The carrying base includes first and second electrodes respectively corresponding to the first and second electrode portions. The first and second electrodes and the ignition structure are located on two opposite sides of the carrying base. The first and second conductive layers electrically connect the first electrode portion and the first electrode, and the second electrode portion and the second electrode respectively.

13 Claims, 6 Drawing Sheets

IGNITION RESISTOR AND METHOD FOR MANUFACTURING THE SAME

RELATED APPLICATIONS

This application claims priority to China Application Serial Number 202110031995.8, filed Jan. 11, 2021, which is herein incorporated by reference.

BACKGROUND

Field of Invention

The present disclosure relates to a technique for manufacturing a resistor, and more particularly, to an ignition resistor and a method for manufacturing the same.

Description of Related Art

A conventional electric ignition device generates arc discharge mainly by applying high voltage between two electrodes to emit spark, so as to provide an ignition function. As the rapid development of technology, a surface mount ignition resistor has been developed. In the surface mount ignition resistor, a narrow channel of low resistance is designed, such that the narrow channel is fused and sparks when digital voltage passes through the narrow channel in a short time to achieve an ignition function.

In the forming of the conventional surface mount ignition resistor, it needs to bond an ignition device to a circuit board firstly, and an ignition material, such as pyrotechnic powder, is then put on a narrow channel. However, the narrow channel is small, such that it is not easy to put the ignition material on the narrow channel accurately, and the location of the ignition material is deviated. The deviating of the ignition material results in ignition failure or poor ignition effect of the ignition resistor.

SUMMARY

Therefore, one objective of the present disclosure is to provide an ignition resistor and a method for manufacturing the same, in which an insulation substrate includes a filling portion, and a hole of the filling portion aligns with and exposes an ignition portion of an ignition structure. Thus, an ignition material can be accurately disposed on the ignition portion via the hole to easily complete disposition of the ignition material. Therefore, the application of the present disclosure can ensure an ignition effect of the ignition resistor, thereby enhancing quality and reliability of the ignition resistor.

According to the aforementioned objectives, the present disclosure provides an ignition resistor. The ignition resistor includes an ignition structure, an insulation substrate, a carrying base, a first conductive layer, and a second conductive layer. The ignition structure includes a first electrode portion, an ignition portion, and a second electrode portion. The first electrode portion and the second electrode portion are respectively connected to two opposite ends of the ignition portion. The insulation substrate is disposed on the ignition structure. The insulation substrate includes a filling portion, and the filling portion includes a hole and a sidewall surrounding the hole. The hole exposes the ignition portion. The hole is configured to accommodate an ignition material. The carrying base is disposed under the ignition structure. The carrying base includes a first electrode and a second electrode respectively corresponding to the first electrode portion and the second electrode portion. The first electrode and the second electrode, and the ignition structure are respectively located on two opposite sides of the carrying base. The first conductive layer electrically connects the first electrode portion and the first electrode. The second conductive layer electrically connects the second electrode portion and the second electrode.

According to one embodiment of the present disclosure, a material of the ignition structure is a NiCr alloy, a CuNi alloy, or Cu.

According to one embodiment of the present disclosure, a thermal conductivity coefficient of the insulation substrate is equal to or smaller than 0.2 W/mK.

According to one embodiment of the present disclosure, a material of the insulation substrate is polyimide (PI), polycarbonate (PC), glass fiber, a ceramic material, or a FR4 material.

According to one embodiment of the present disclosure, the first conductive layer passes through the sidewall, the first electrode portion, the carrying base, and the first electrode; and the second conductive layer passes through the sidewall, the second electrode portion, the carrying base, and the second electrode.

According to one embodiment of the present disclosure, the ignition structure, the insulation substrate, and the carrying base constitute a main structure of the ignition resistor, the first conductive layer covers a first side surface of the main structure, and the second conductive layer covers a second side surface of the main structure.

According to the aforementioned objectives, the present disclosure further provides a method for manufacturing an ignition resistor. In this method, a conductive sheet is provided, in which the conductive sheet has a first surface and a second surface which are opposite to each other. The conductive sheet includes various ignition structures, each of the ignition structures includes a first electrode portion, an ignition portion, and a second electrode portion, and the first electrode portion and the second electrode portion are respectively connected to two opposite ends of the ignition portion. The insulation substrate is adhered to the first surface of the conductive sheet, in which the insulation substrate includes various filling portions respectively corresponding to the ignition structures. Each of the filling portions includes a hole and a sidewall surrounding the hole. The adhering of the insulation substrate includes aligning the holes with the ignition portions respectively. Each of the holes is configured to accommodate an ignition material. A first surface of a carrying base is adhered to the second surface of the conductive sheet. The carrying base includes various first electrodes and various second electrodes disposed on a second surface of the carrying base opposite to the first surface. The first electrodes respectively correspond to the first electrode portions, and the second electrodes respectively correspond to the second electrode portions. Various first conductive layers are formed to respectively connect the corresponding first electrode portions and the first electrodes. Various second conductive layers are formed to respectively connect the corresponding second electrode portions and the second electrodes.

According to one embodiment of the present disclosure, the conductive sheet is a metal foil.

According to one embodiment of the present disclosure, a material of the conductive sheet is a NiCr alloy, a CuNi alloy, or Cu.

According to one embodiment of the present disclosure, a thermal conductivity coefficient of the insulation substrate is equal to or smaller than 0.2 W/mK.

According to one embodiment of the present disclosure, a material of the insulation substrate is polyimide, polycarbonate, glass fiber, a ceramic material, or a FR4 material.

According to one embodiment of the present disclosure, the forming of the first conductive layers and the second conductive layers includes: forming various first through holes to respectively pass through the sidewalls, the first electrode portions, the carrying base, and the first electrodes; forming various second through holes to respectively pass through the sidewalls, the second electrode portions, the carrying base, and the second electrodes; forming the first conductive layers to respectively fill the first through holes; and forming the second conductive layers to respectively fill the second through holes.

According to one embodiment of the present disclosure, after adhering the carrying base, the method further includes performing a dividing step to form various main structures of various ignition resistors. The forming of the first conductive layers and the second conductive layers includes: forming the first conductive layers to correspondingly cover first side surfaces of the main structures respectively; and forming the second conductive layers to correspondingly cover second side surfaces of the main structures respectively.

BRIEF DESCRIPTION OF THE DRAWINGS

The aforementioned and other objectives, features, advantages, and embodiments of the present disclosure can be more fully understood by reading the following detailed description of the embodiment, with reference made to the accompanying drawings as follows.

DETAILED DESCRIPTION

Figure 1:
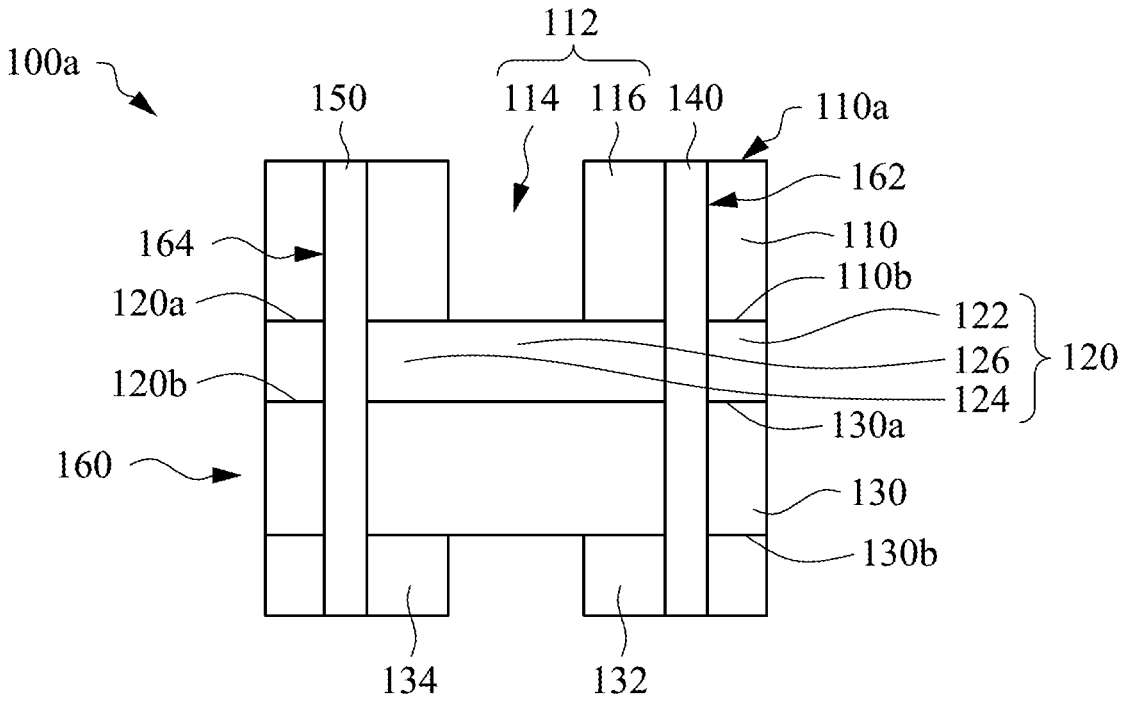
FIG. 1 is a schematic cross-sectional view of an ignition resistor in accordance with a first embodiment of the present disclosure.

The embodiments of the present disclosure are discussed in detail below. However, it will be appreciated that the embodiments provide many applicable concepts that can be implemented in various specific contents. The embodiments discussed and disclosed are for illustrative purposes only and are not intended to limit the scope of the present disclosure. All of the embodiments of the present disclosure disclose various different features, and these features may be implemented separately or in combination as desired.

In addition, the terms "first", "second", and the like, as used herein, are not intended to mean a sequence or order, and are merely used to distinguish elements or operations described in the same technical terms.

The spatial relationship between two elements described in the present disclosure applies not only to the orientation depicted in the drawings, but also to the orientations not represented by the drawings, such as the orientation of the inversion. Furthermore, the terms "connected", "electrically connected" or the like between two components referred to in the present disclosure are not limited to the direct connection or electrical connection of the two components, and may also include indirect connection or electrical connection as required.

Referring to FIG. 1, FIG. 1 is a schematic cross-sectional view of an ignition resistor in accordance with a first embodiment of the present disclosure. An ignition resistor 100*a* is a surface mount ignition resistor. In some examples, the ignition resistor 100*a* may mainly include an insulation substrate 110, an ignition structure 120, a carrying base 130, a first conductive layer 140, and a second conductive layer 150.

The insulation substrate 110 has a first surface 110*a* and a second surface 110*b*, which are opposite to each other. The insulation substrate 110 includes a filling portion 112. The filling portion 112 may mainly include a hole 114 and a sidewall 116. The hole 114 extends from the first surface 110*a* to the second surface 110*b* of the insulation substrate 110 to pass through the insulation substrate 110. The hole 114 is configured to accommodate an ignition material. For example, the sidewall 116 may be an annular structure and surround the hole 114 to benefit the filling of the ignition material. In some examples, in addition to electrical insulation, the insulation substrate 110 also has a property of poor thermal conductivity. For example, a thermal conductivity coefficient of the insulation substrate 110 is equal to or smaller than about 0.2 W/mK. In some exemplary examples, a material of the insulation substrate 110 is polyimide, polycarbonate, glass fiber, a ceramic material, or a FR4 material.

The ignition structure 120 has a first surface 120*a* and a second surface 120*b*, which are respectively located on two opposite sides of the ignition structure 120. The insulation substrate 110 is disposed on the ignition structure 120, and the second surface 110*b* of the insulation substrate 110 may be adhered to the first surface 120*a* of the ignition structure 120, for example. The ignition structure 120 includes a first electrode portion 122, a second electrode portion 124, and an ignition portion 126. The first electrode portion 122 and the second electrode portion 124 are respectively connected to two opposite ends of the ignition portion 126. When the insulation substrate 110 is disposed on the first surface 120*a* of the ignition structure 120, the hole 114 of the filling portion 112 aligns with the ignition portion 126 and exposes the ignition portion 126. Two opposite sides of the sidewall 116 of the filling portion 112 are respectively stacked on the first electrode portion 122 and the second electrode portion 124. Thus, the filling portion 112 can define an accommodation space for filling the ignition material on the ignition structure 120.

Figure 4:
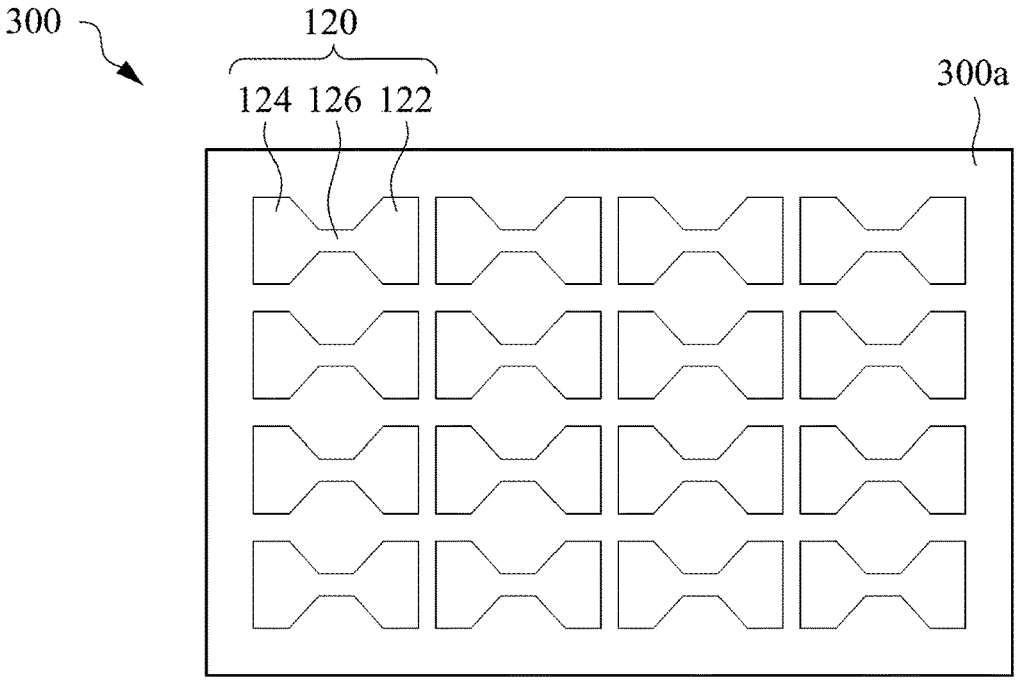
FIG. 4 is a schematic top view of a conductive sheet in accordance with one embodiment of the present disclosure.

Referring to FIG. 4 firstly, FIG. 4 is a schematic top view of a conductive sheet in accordance with one embodiment of the present disclosure. A conductive sheet 300 includes many ignition structures 120. In the example shown in FIG. 4, the ignition structure 120 is an H-shaped structure, i.e. a width of the ignition portion 126, which is located between the first electrode portion 122 and the second electrode portion 124, is smaller than a width of the first electrode portion 122 and a width of the second electrode portion 124. The width of the first electrode portion 122 and the width of the second electrode portion 124 are respectively referred to an average width of the first electrode portion 122 and an average width of the second electrode portion 124 herein. The shape of the ignition structure of the present disclosure is not limited to the above example, and it only needs that a radial dimension of the ignition portion is smaller than radial dimensions of the electrode portions, which are located at two sides of the ignition portion. For example, the ignition structure may be an S-shaped structure. In some exemplary examples, the ignition structure 120 is an integral structure. However, the ignition structure 120 may also be a non-integral structure. A material of the ignition structure 120 is a conductive material, such as a metal material. For example, the material of the ignition structure 120 is a NiCr alloy, a CuNi alloy, or Cu.

The carrying base 130 also has a first surface 130*a* and a second surface 130*b*, which are opposite to each other. The carrying base 130 is disposed under the ignition structure 120, the first surface 130*a* of the carrying base 130 may be, for example, adhered to the second surface 120*b* of the ignition structure 120, such that carrying base 130, the insulation substrate 110, and the ignition structure 120 constitute a main structure 160 of the ignition resistor 100*a*. The carrying base 130 includes a first electrode 132 and a second electrode 134. The first electrode 132 and the second electrode 134 are disposed on the second surface 130*b* of the carrying base 130, such that the first electrode 132 and the second electrode 134, and the ignition structure 120 are respectively located on two opposite sides of the carrying base 130. The first electrode 132 and the second electrode 134 are separated from each other. The first electrode 132 and the second electrode 134 respectively correspond to the first electrode portion 122 and the second electrode portion 124 of the ignition structure 120, i.e. the first electrode portion 122 and the second electrode portion 124 are respectively stacked above the first electrode 132 and the second electrode 134.

The carrying base 130 is an insulation base, and preferably has a property of poor thermal conductivity. In some exemplary examples, a material of the carrying base 130 is glass fiber or a FR4 material. Materials of the first electrode 132 and the second electrode 134 may be metal with good electrical conductivity. For example, the materials of the first electrode 132 and the second electrode 134 may be Ag or Cu.

The first conductive layer 140 electrically connects the first electrode portion 122 of the ignition structure 120 and the first electrode 132. In the example shown in FIG. 1, the main structure 160 has a first through hole 162. The first through hole 162 extends from the first surface 110*a* of the insulation substrate 110 to the first electrode 132 through the insulation substrate 110, the first electrode portion 122 of the ignition structure 120, and the carrying base 130. That is the first through hole 162 passes through the sidewall 116 of the insulation substrate 110 on the first electrode portion 122, the first electrode portion 122, and the carrying base 130 to expose a portion of the first electrode 132. In some examples, the first through hole 162 passes through the first electrode 132. For example, an axis of the first through hole 162 may be substantially perpendicular to the main structure 160. The first conductive layer 140 fills the first through hole 162 to connect the first electrode portion 122 and the first electrode 132, so as to achieve electrical connection between the first electrode portion 122 and the first electrode 132. A material of the first conductive layer 140 may be metal, such as Cu or a Cu alloy.

The second conductive layer 150 electrically connects the second electrode portion 124 of the ignition structure 120 and the second electrode 134. The main structure 160 further has a second through hole 164. The second through hole 164 extends from the first surface 110*a* of the insulation substrate 110 to the second electrode 134 through the insulation substrate 110, the second electrode portion 124 of the ignition structure 120, and the carrying base 130. That is the second through hole 164 passes through the sidewall 116 of the insulation substrate 110 on the second electrode portion 124, the second electrode portion 124, and the carrying base 130 to expose a portion of the second electrode 134. In some examples, the second through hole 164 passes through the second electrode 134. Similarly, an axis of the second through hole 164 may be substantially perpendicular to the main structure 160. The second conductive layer 150 fills the second through hole 164 to connect the second electrode portion 124 and the second electrode 134, so as to electrically connect the second electrode portion 124 and the second electrode 134. A material of the second conductive layer 150 may be metal, such as Cu or a Cu alloy.

The ignition material can be accurately disposed on the ignition portion 126 by disposing the insulation substrate 110 having the filling portion 112 on the ignition structure 120 and aligning the hole 114 of the filling portion 112 with the ignition portion 126 of the ignition structure 120. Therefore, reliability of the ignition resistor 100*a* is increased, thereby enhancing an ignition effect.

Figure 2:
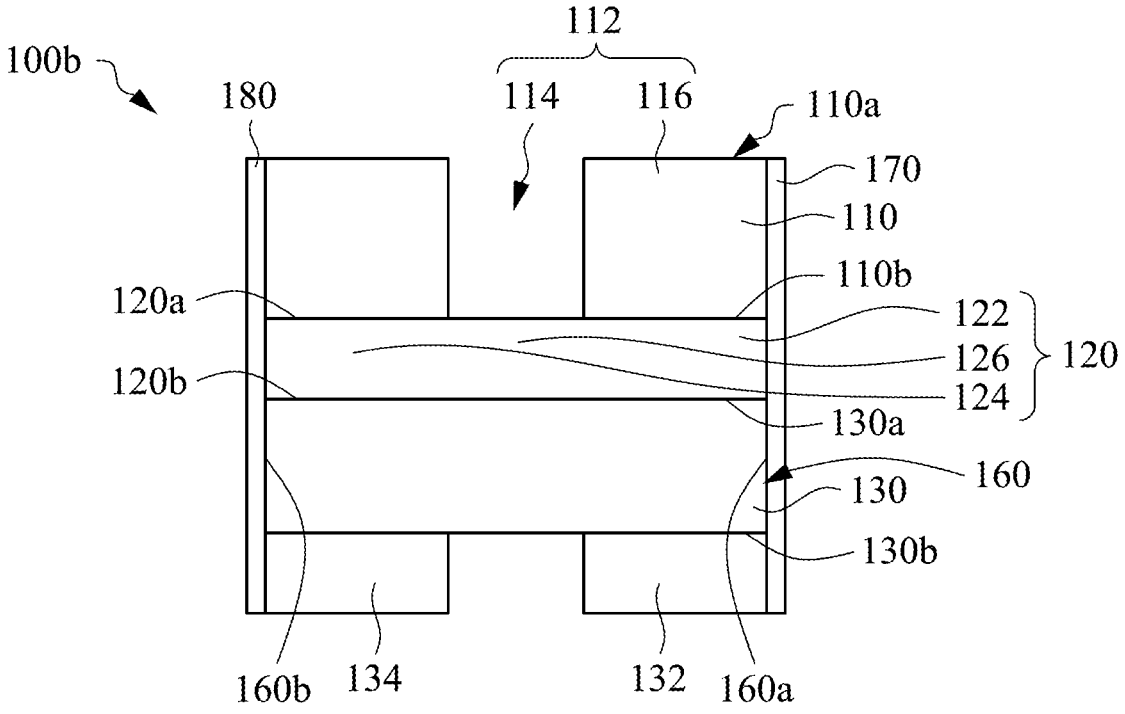
FIG. 2 is a schematic cross-sectional view of an ignition resistor in accordance with a second embodiment of the present disclosure.

Referring FIG. 2, FIG. 2 is a schematic cross-sectional view of an ignition resistor in accordance with a second embodiment of the present disclosure. A structure of an ignition resistor 100*b* of the present embodiment is substantially similar to that of the above ignition resistor 100*a*, and a difference between the ignition resistors 100*b* and 100*a* is that a first conductive layer 170 and a second conductive layer 180 of the ignition resistor 100*b* do not penetrate the main structure 160.

The main structure 160 has a first side surface 160*a* and a second side surface 160*b*. For example, the first side surface 160*a* and the second side surface 160*b* may be respectively located on two opposite sides of the main structure 160. The first conductive layer 170 covers the first side surface 160*a* of the main structure 160. The first conductive layer 170 at least extends from the first electrode portion 122 of the ignition structure 120 to the first electrode 132 to simultaneously connect the first electrode portion 122 and the first electrode 132, so as to electrically connect the first electrode portion 122 and the first electrode 132. The second conductive layer 180 covers the second side surface 160*b* of the main structure 160. The second conductive layer 180 at least extends from the second electrode portion 124 of the ignition structure 120 to the second electrode 134 to simultaneously connect the second electrode portion 124 and the second electrode 134, so as to achieve electrical connection between the second electrode portion 124 and the second electrode 134.

Figure 3:
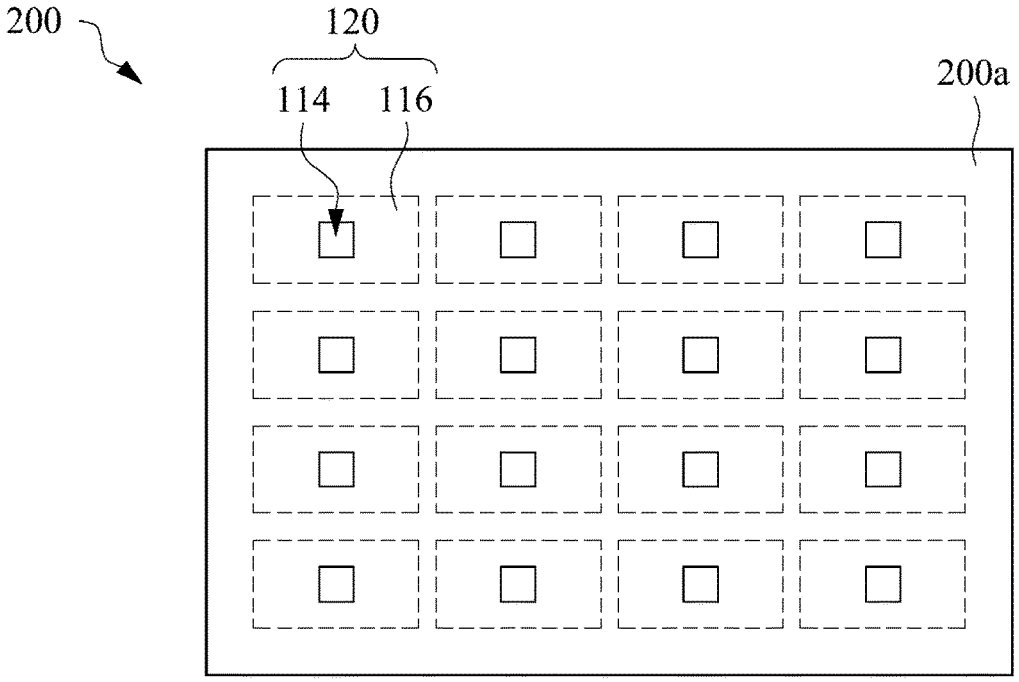
FIG. 3 is a schematic top view of an insulation substrate in accordance with one embodiment of the present disclosure.
Figure 5:
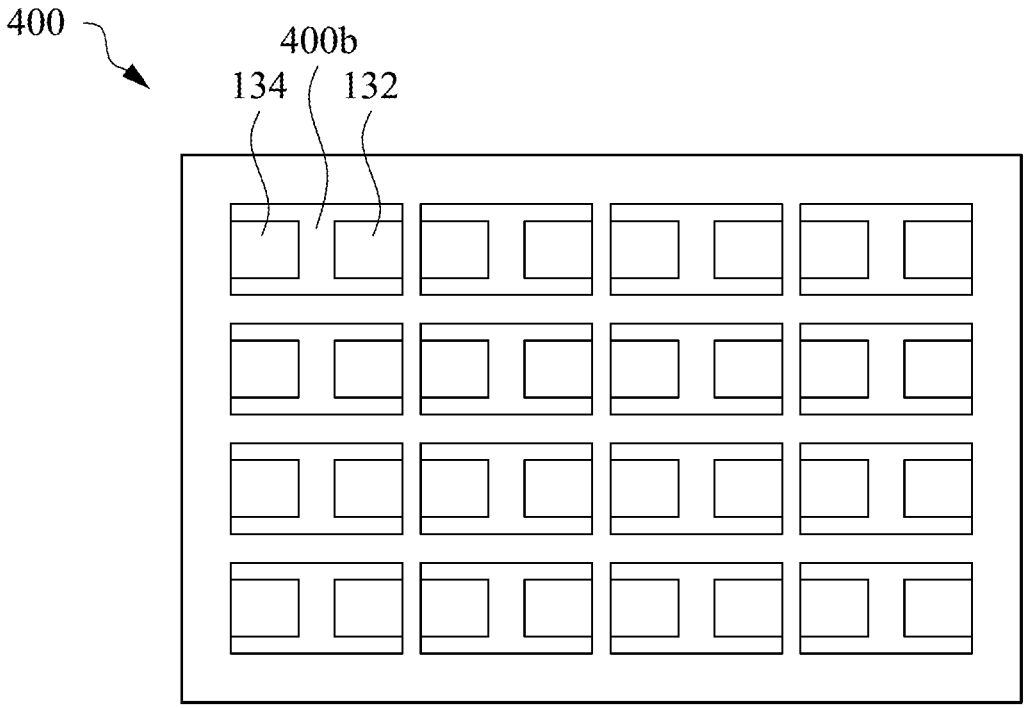
FIG. 5 is a schematic bottom view of a carrying base in accordance with one embodiment of the present disclosure.
Figure 6A:
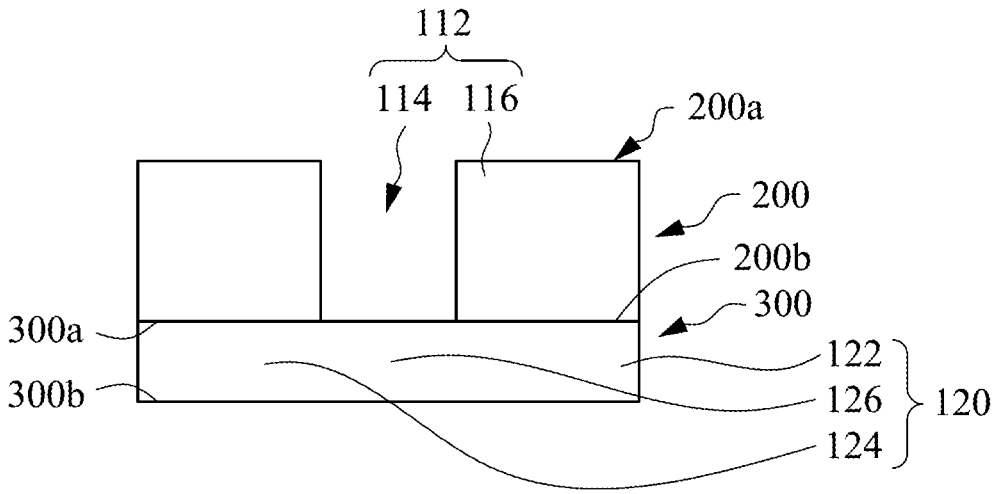
FIG. 6A to FIG. 6D are schematic partial cross-sectional views of various intermediate stages showing a method for manufacturing an ignition resistor in accordance with a first embodiment of the present disclosure.
Figure 6B:
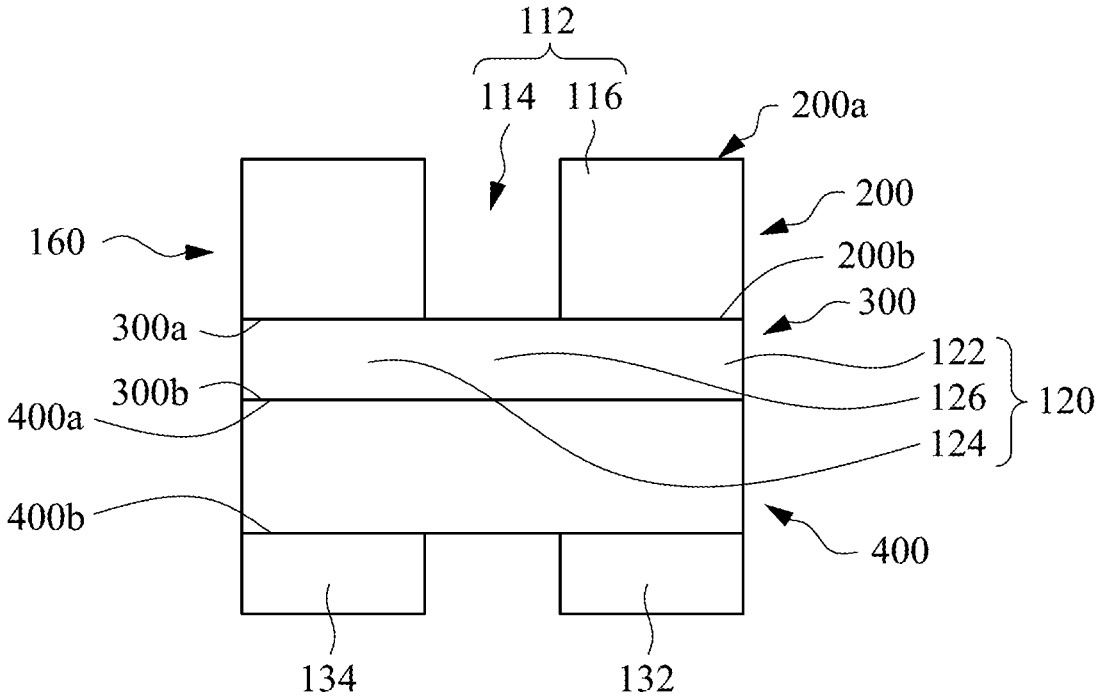
Figure 6C:
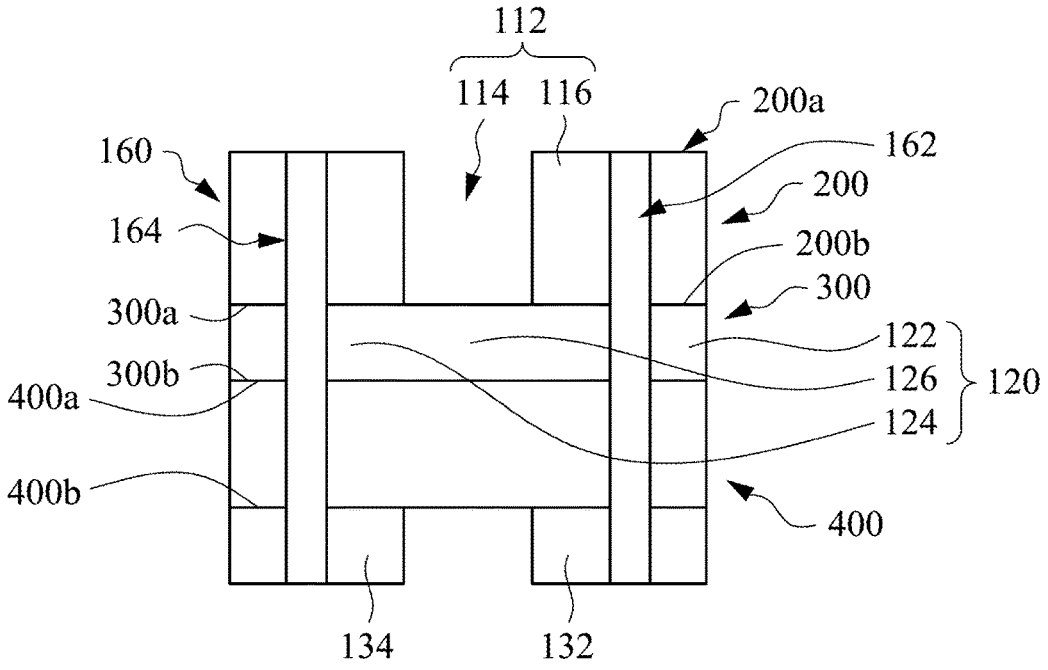
Figure 6D:
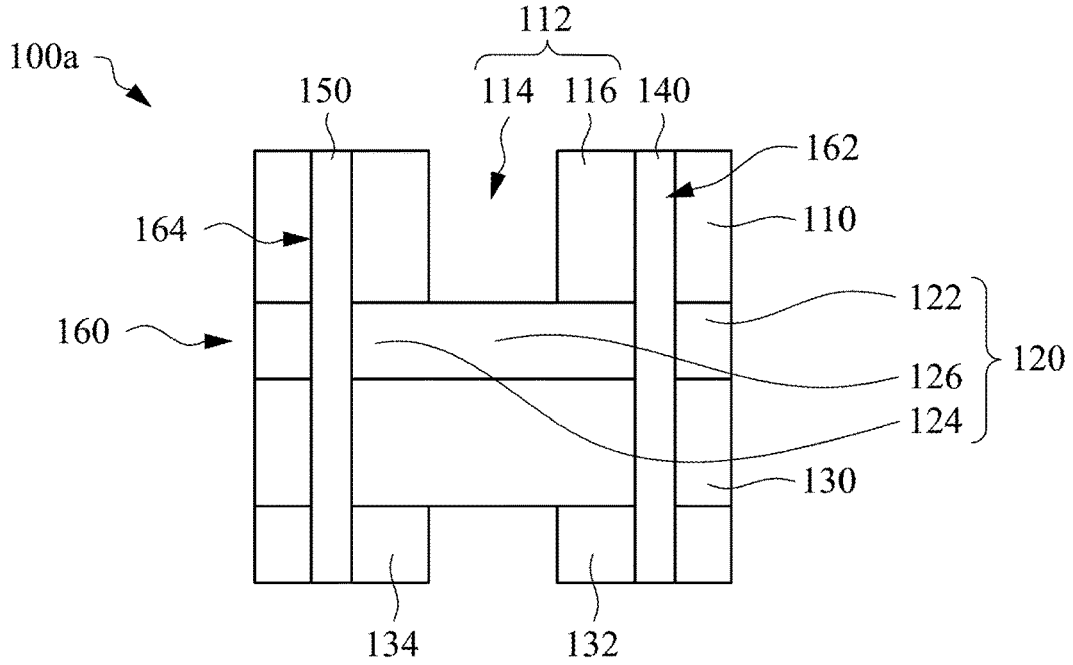

Referring to FIG. 3 to FIG. 6D, FIG. 3 and FIG. 5 are respectively a schematic top view of an insulation substrate and a schematic bottom view of a carrying base in accordance with one embodiment of the present disclosure, and FIG. 6A to FIG. 6D are schematic partial cross-sectional views of various intermediate stages showing a method for manufacturing an ignition resistor in accordance with a first embodiment of the present disclosure. In the manufacturing of an ignition resistor 100*a* as shown in FIG. 6D, an insulation substrate 200 as shown in FIG. 3, a conductive sheet 300 as shown in FIG. 4, and a carrying base 400 as shown in FIG. 5 may be provided. In the present embodiment, a sequence of providing the insulation substrate 200, the conductive sheet 300, and the carrying base 400 may be adjusted according to the practical process requirements. In some exemplary examples, the insulation substrate 200 may be provided firstly, the conductive sheet 300 may be provided next, and then the carrying base 400 may be provided.

Referring to FIG. 3 and FIG. 6A simultaneously, the insulation substrate 200 has a first surface 200*a* and a second surface 200*b*, which are opposite to each other. The insulation substrate 200 includes various filling portions 112. Each of the filling portions 112 includes a hole 114 and a sidewall 116 surrounding the hole 114. Each of the holes 114 extends from the first surface 200*a* to the second surface 200*b* of the insulation substrate 200, and is a through hole passing through the insulation substrate 200. The holes 114 are used to accommodate ignition materials, such that spaces for filling the ignition materials can be clearly defined via the filling portions 112. These filling portions 112 may be arranged according to a predetermined rule. For example, these filling portions 112 may be arranged with a constant pitch. In some exemplary examples, the filling portions 112 may be arranged in a matrix. In some examples, the insulation substrate 200 is non-conductive and has a property of poor thermal conductivity. A thermal conductivity coefficient of the insulation substrate 200 may be, for example, equal to or smaller than about 0.2 W/mK. In some exemplary examples, a material of insulation substrate 200 is polyimide, polycarbonate, glass fiber, a ceramic material, or a FR4 material.

For example, a dimension and a shape of the conductive sheet 300 may be the same as a dimension and a shape of the insulation substrate 200. As shown in FIG. 4, the conductive sheet 300 includes various ignition structures 120. In some examples, in forming the conductive sheet 300, a metal foil is firstly provided, and a portion of the metal foil is removed by, for example, an etching method to form the ignition structures 120. For example, a material of the conductive sheet 300 may be a NiCr alloy, a CuNi alloy, or Cu. Referring to FIG. 6A, the conductive sheet 300 has a first surface 300*a* and a second surface 300*b*, in which the first surface 300*a* and the second surface 300*b* are respectively located on two opposite sides of the conductive sheet 300.

A number of the ignition structures 120 may be the same as a number of the filling portions 112. In addition, locations of the ignition structures 120 respectively correspond to locations of the filling portions 112 of the insulation substrate 200. Therefore, an arrangement rule of the ignition structures 120 is the same as an arrangement rule of the filling portions 112. Each of the ignition structures 120 includes a first electrode portion 122, an ignition portion 126, and a second electrode portion 124. In some examples, the first electrode portion 122 and the second electrode portion 124 are respectively connected to two opposite ends of the ignition portion 126 to form an H-shaped structure. In some examples, the ignition structure may be in other shape, such as S-like shape, in which a radial dimension of the ignition portion is smaller than radial dimensions of the electrode portions, which are located on two opposite sides of the ignition portion.

Referring to FIG. 5 and FIG. 6B simultaneously, the carrying base 400 has a first surface 400*a* and a second surface 400*b*, which are opposite to each other. The carrying base 400 includes various first electrodes 132 and various second electrodes 134. These first electrodes 132 respectively correspond to the second electrodes 134, such that the first electrodes 132 and the second electrodes 134 have the same quality. These first electrodes 132 and the second electrodes 134 all are disposed on the second surface 400*b* of the carrying base 400. Each of the first electrode 132 and the corresponding second electrode 134 are separated from and opposite to each other.

The numbers of the first electrodes 132 and the corresponding second electrode 134 may be the same as the number of the ignition structures 120 and the number of the filling portions 112. In addition, locations of the first electrode 132 and the corresponding second electrodes 134 correspond to the locations of the filling portions 112 of the insulation substrate 200 and the locations of the ignition structures120 of the conductive sheet 300. Therefore, an arrangement rule of the first electrodes 132 and the corresponding second electrodes 134 is the same as the arrangement rule of the filling portions 112 and the arrangement rule of the ignition structures 120. The locations of the first electrodes 132 and the second electrodes 134 respectively correspond to the locations of the first electrode portions 122 and the second electrode portions 124 of the corresponding ignition structures 120.

The carrying base 400 is an insulation base and has a property of poor thermal conductivity. A material of the carrying base 400 may be, for example, glass fiber or a FR4 material. In some examples, the first electrodes 132 and the second electrodes 134 may be formed by using a print method with low temperature silver glue or a chemical disposition method. Materials of the first electrodes 132 and the second electrodes 134 may be metal with good electrical conductivity, such as Ag or Cu.

In some examples, as shown in FIG. 6A, after the insulation substrate 200 and the conductive sheet 300 are provided, the second surface 200*b* of the insulation substrate 200 may be adhered to the first surface 300*a* of the conductive sheet 300. The adhering of the insulation substrate 200 to the conductive sheet 300 includes aligning the holes 114 of the filling portions 112 of the insulation substrate 200 with the ignition portions 126 of the corresponding ignition structures 120 of the conductive sheet 300, such that the holes 114 can expose the ignition portions 126. Meanwhile, two opposite sides of the sidewall 116 of each of the filling portions 112 may be respectively stacked on the first electrode portion 122 and the second electrode portion 124 of the ignition structure 120.

Next, the first surface 400*a* of the carrying base 400 may be correspondingly adhered to the second surface 300*b* of the conductive sheet 300. When the carrying base 400 is adhered to the conductive sheet 300, the first electrodes 132 of the carrying base 400 are correspondingly stacked with the first electrode portions 122 of the ignition structures 120 of the conductive sheet 300, and the second electrodes 134 are correspondingly stacked with the second electrode portions 124 of the ignition structures 120, respectively. Each of the filling portions 112, the ignition structure 120 stacked with the filling portion 112, and a portion of the carrying base 400 constitute a main structure 160 of the ignition resistor 100*a* shown in FIG. 6D.

In the aforementioned embodiment, the insulation substrate 200 is firstly adhered to the conductive sheet 300, and then the carrying base 400 is adhered to the conductive sheet 300. However, the present disclosure is not limited thereto, and the conductive sheet 300 may be also adhered to the carrying base 400 firstly, and then the insulation substrate 200 may be adhered to the conductive sheet 300. In some examples, the insulation substrate 200, the conductive sheet 300, and the carrying base 400 may be combined together by using a vacuum pressing method.

Then, a first conductive layer 140 and a second conductive layer 150 may be formed in the main structure 160 of each of the ignition resistors 100*a*, as shown in FIG. 6D. In some examples, as shown in FIG. 6C, in the forming of the first conductive layer 140, a first through hole 162 may be firstly formed in each of the main structures 160. The first through hole 162 may, for example, pass through the sidewall 116 of the filling portion 112 on the first electrode portion 122, the first electrode portion 122, the carrying base 400 under the first electrode portion 122, and the first electrode 132. Various first conductive layers 140 are formed by using, for example, a chemical plating method to respectively fill the first through holes 162, so as to electrically connect the first electrode portion 122 and the first electrode 132 of each of the main structures 160.

Similarly, in the forming of the second conductive layer 150, a second through hole 164 may be firstly formed in each of the main structures 160. The second through hole 164 may, for example, pass through the sidewall 116 of the filling portion 112 on the second electrode portion 124, the second electrode portion 124, the carrying base 400 under the second electrode portion 124, and the second electrode 134. Various second conductive layers 150 are formed by using, for example, a chemical plating method to respectively fill the second through holes 164, so as to electrically connect the second electrode portion 124 and the second electrode 134 of each of the main structures 160. The first conductive layers 140 and the second conductive layers 150 may be formed together.

After the first conductive layers 140 and the second conductive layers 150 are completed, a dividing step may be performed to separate the main structures 160, so as to substantially complete the manufacturing of the ignition resistors 100*a*, as shown in FIG. 6D. An insulation substrate 110 of the main structure 160 is a portion of the insulation substrate 200, and a carrying base 130 is a portion of the varying base 400. In the above example, the first conductive layer 140 and the second conductive layer 150 of each of the ignition resistors 100*a* are firstly formed, and the dividing step is performed. In the embodiment, the dividing step may also be performed firstly to separate the main structures 160, and then the first conductive layer 140 and the second conductive layer 150 of each of the ignition resistor 100*a* may be formed.

Figure 7:
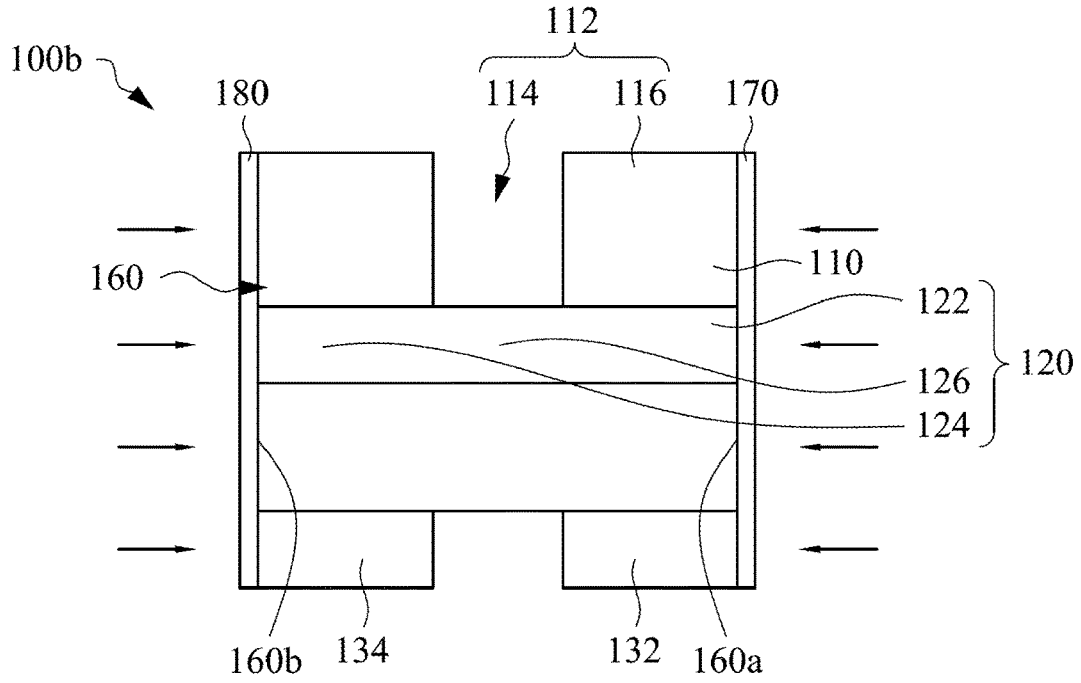
FIG. 7 is a schematic cross-sectional view showing a method for manufacturing a first conductive layer and a second conductive layer of an ignition resistor in accordance with a second embodiment of the present disclosure.

Referring FIG. 7, FIG. 7 is a schematic cross-sectional view showing a method for manufacturing a first conductive layer and a second conductive layer of an ignition resistor in accordance with a second embodiment of the present disclosure. After the stacking of the insulation substrate 200, the conductive sheet 300, and the carrying base 400 is completed to form the structure shown in FIG. 6B, a dividing step is firstly performed to divide the structure into various main structures 160. As shown in FIG. 7, each of the main structures 160 has a first side surface 160*a* and a second side surface 160*b*. For example, the first side surface 160*a* and the second side surface 160*b* may be respectively located on two opposite sides of the main structure 160.

A first conductive layer 170 and a second conductive layer 180 of each of the main structures 160 may be formed by using, for example, a typical method for forming terminal electrodes of a resistance device. For example, the first conductive layer 170 may be formed to cover the first side surface 160*a* of the main structure 160, and the second conductive layer 180 may be formed to cover the second side surface 160*b* of the main structure 160 by using a vacuum sputtering method. The first conductive layer 170 at least extends from the first electrode portion 122 to the first electrode 132 to electrically connect the first electrode portion 122 and the first electrode 132. The second conductive layer 180 at least extends from the second electrode portion 124 to the second electrode 134 to electrically connect the second electrode portion 124 and the second electrode 134.

Figure 8:
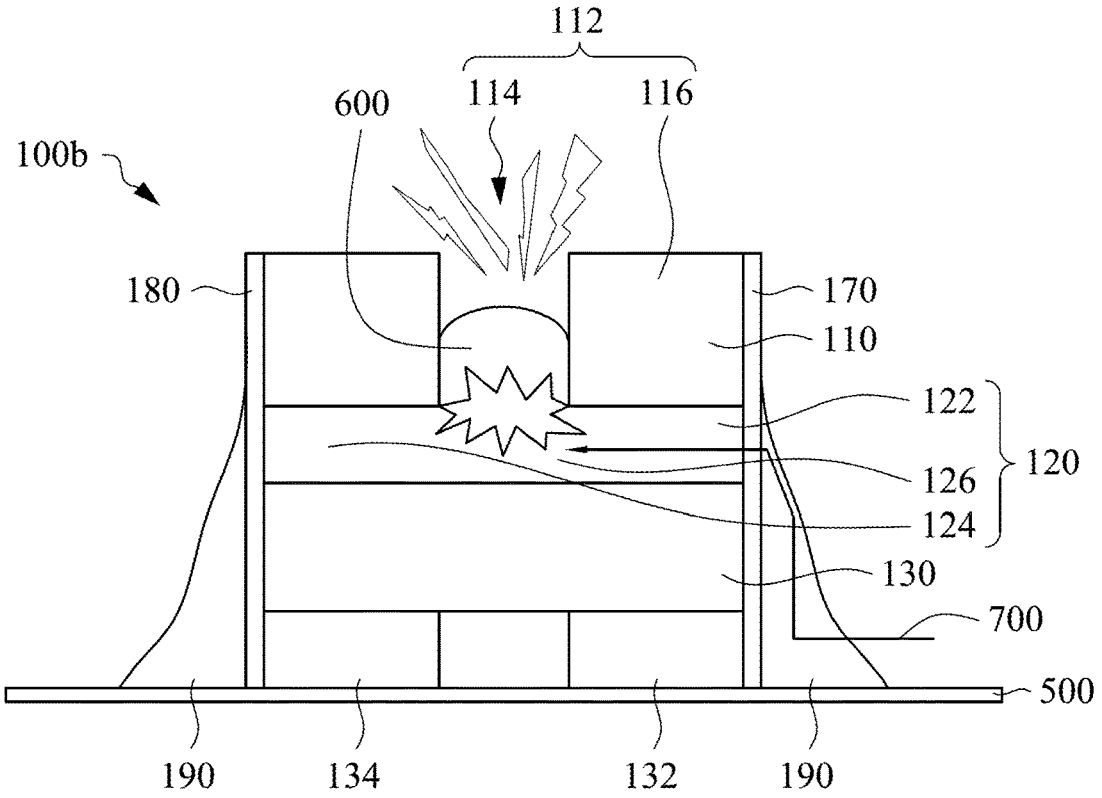
FIG. 8 is a schematic diagram showing an ignition material is ignited by an ignition resistor in accordance with one embodiment of the present disclosure.

In application, the ignition resistor may be disposed on a device or a circuit board by using a bonding layer, and the ignition resistor is filled with an ignition material. Referring to FIG. 8, FIG. 8 is a schematic diagram showing an ignition material is ignited by an ignition resistor in accordance with one embodiment of the present disclosure. In some examples, the ignition resistor 100*b* is fixed on a circuit board 500 by using a bonding material 190, and the first electrode 132 and the second electrode 134 of the ignition resistor 100*b* are electrically connected to a circuit on the circuit board 500. The bonding material 190 may be formed by, for example, a plating method to bond the ignition resistor 100*b* and the circuit board 500. The bonding material 190 may be a NiSn alloy, for example.

The hole 114 of the filling portion 112 is filled with an ignition material 600. The hole 114 of the filling portion 112 aligns with the ignition portion 126 of the ignition structure 120, such that the ignition material 600 can be accurately disposed on the ignition portion 126. After being electrified through the circuit board, the ignition portion 126 can spark to ignite the ignition material 600 on the ignition portion 126, so as to cause a reaction, such as blasting.

The above embodiment is a process for manufacturing various ignition resistors 100*a* or 100*b* simultaneously, and the ignition resistor 100*a* or 100*b* may be also manufactured singly. After the insulation substrate 110, the ignition structure 120, and the carrying base 130 of the main structure 160 of the ignition resistor 100*a* or 100*b* are stacked in sequence, the first conductive layer 140 and the second conductive layer 150, or the first conductive layer 170 and the second conductive layer 180 may be formed by using the above example methods.

According to the aforementioned embodiments, one advantage of the present disclosure is that an insulation substrate of an ignition resistor of the present disclosure includes a filling portion, and a hole of the filling portion aligns with and exposes an ignition portion of an ignition structure, such that an ignition material can be accurately disposed on the ignition portion via the hole to easily complete disposition of the ignition material. Therefore, the application of the present disclosure can ensure an ignition effect of the ignition resistor, thereby enhancing quality and reliability of the ignition resistor.

Although the present disclosure has been described in considerable details with reference to certain embodiments, the foregoing embodiments of the present disclosure are illustrative of the present disclosure rather than limiting of the present disclosure. It will be apparent to those having ordinary skill in the art that various modifications and variations can be made to the present disclosure without departing from the scope or spirit of the disclosure. Therefore, the spirit and scope of the appended claims should not be limited to the description of the embodiments contained herein.

What is claimed is:

1. An ignition resistor, comprising:

an ignition structure comprising a first electrode portion, an ignition portion, and a second electrode portion, wherein the first electrode portion and the second electrode portion are respectively connected to two opposite ends of the ignition portion;

an insulation substrate disposed on the ignition structure, wherein the insulation substrate comprises a filling portion, the filling portion comprises a hole and a sidewall surrounding the hole, the hole exposes the ignition portion, and the hole is configured to accommodate an ignition material;

a carrying base disposed under the ignition structure, wherein the carrying base comprises a first electrode and a second electrode respectively corresponding to the first electrode portion and the second electrode portion, and the first electrode and the second electrode, and the ignition structure are respectively located on two opposite sides of the carrying base;

a first conductive layer electrically connecting the first electrode portion and the first electrode; and a second conductive layer electrically connecting the second electrode portion and the second electrode.

2. The ignition resistor of claim 1, wherein a material of the ignition structure is a NiCr alloy, a CuNi alloy, or Cu.

3. The ignition resistor of claim 1, wherein a thermal conductivity coefficient of the insulation substrate is equal to or smaller than 0.2 W/mK.

4. The ignition resistor of claim 1, wherein a material of the insulation substrate is polyimide, polycarbonate, glass fiber, a ceramic material, or a FR4 material.

5. The ignition resistor of claim 1, wherein the first conductive layer passing through the sidewall, the first electrode portion, the carrying base, and the first electrode; and the second conductive layer passing through the sidewall, the second electrode portion, the carrying base, and the second electrode.

6. The ignition resistor of claim 1, wherein the ignition structure, the insulation substrate, and the carrying base constitute a main structure of the ignition resistor, the first conductive layer covers a first side surface of the main structure, and the second conductive layer covers a second side surface of the main structure.

7. A method for manufacturing an ignition resistor, comprising:

providing a conductive sheet, wherein the conductive sheet has a first surface and a second surface which are opposite to each other, the conductive sheet comprises a plurality of ignition structures, each of the ignition structures comprises a first electrode portion, an ignition portion, and a second electrode portion, and the first electrode portion and the second electrode portion are respectively connected to two opposite ends of the ignition portion;

adhering an insulation substrate to the first surface of the conductive sheet, wherein the insulation substrate comprising a plurality of filling portions respectively corresponding to the ignition structures, each of the filling portions comprises a hole and a sidewall surrounding the hole, adhering the insulation substrate comprises aligning the holes with the ignition portions respectively, and each of the holes is configured to accommodate an ignition material;

adhering a first surface of a carrying base to the second surface of the conductive sheet, wherein the carrying base comprises a plurality of first electrodes and a plurality of second electrodes disposed on a second surface of the carrying base opposite to the first surface, the first electrodes respectively correspond to the first electrode portions, and the second electrodes respectively correspond to the second electrode portions;

forming a plurality of first conductive layers to respectively connect the corresponding first electrode portions and the first electrodes; and forming a plurality of second conductive layers to respectively connect the corresponding second electrode portions and the second electrodes.

8. The method of claim 7, wherein the conductive sheet is a metal foil.

9. The method of claim 7, wherein a material of the conductive sheet is a NiCr alloy, a CuNi alloy, or Cu.

10. The method of claim 7, wherein a thermal conductivity coefficient of the insulation substrate is equal to or smaller than 0.2 W/mK.

11. The method of claim 7, wherein a material of the insulation substrate is polyimide, polycarbonate, glass fiber, a ceramic material, or a FR4 material.

12. The method of claim 7, wherein forming the first conductive layers and the second conductive layers comprises:

forming a plurality of first through holes to respectively pass through the sidewalls, the first electrode portions, the carrying base, and the first electrodes;

forming a plurality of second through holes to respectively pass through the sidewalls, the second electrode portions, the carrying base, and the second electrodes;

forming the first conductive layers to respectively fill the first through holes; and forming the second conductive layers to respectively fill the second through holes.

13. The method of claim 7, wherein after adhering the carrying base, the method further comprises performing a dividing step to form a plurality of main structures of a plurality of ignition resistors, and wherein forming the first conductive layers and the second conductive layers comprises:

forming the first conductive layers to correspondingly cover a plurality of first side surfaces of the main structures respectively; and forming the second conductive layers to correspondingly cover a plurality of second side surfaces of the main structures respectively.

* * * * *